US010526857B2

(12) United States Patent
Levie et al.

(10) Patent No.: US 10,526,857 B2
(45) Date of Patent: Jan. 7, 2020

(54) RADIAL SPRING LOCK SYSTEM FOR COLLARS, SLEEVES AND CENTRALIZERS

(71) Applicant: Antelope Oil Tool & Mfg. Co., LLC, Houston, TX (US)

(72) Inventors: David E. Y. Levie, Kastanienbaum (CH); Richard Ronald Baynham, Marina di Ravenna (IT)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 97 days.

(21) Appl. No.: 15/834,367

(22) Filed: Dec. 7, 2017

(65) Prior Publication Data

US 2018/0155997 A1 Jun. 7, 2018

Related U.S. Application Data

(60) Provisional application No. 62/431,149, filed on Dec. 7, 2016.

(51) Int. Cl.
*E21B 17/10* (2006.01)
*E21B 23/01* (2006.01)

(52) U.S. Cl.
CPC ..... *E21B 23/01* (2013.01); *E21B 17/1078* (2013.01)

(58) Field of Classification Search
CPC ..... E21B 17/1078
USPC ..... 166/380
See application file for complete search history.

(56) References Cited

U.S. PATENT DOCUMENTS

2007/0222217 A1* 9/2007 Bennett ..... F16L 25/12 285/373
2010/0218956 A1* 9/2010 Buytaert ..... E21B 17/1028 166/382
2015/0285419 A1* 10/2015 Hinkle ..... F16L 47/00 285/420

* cited by examiner

*Primary Examiner* — Taras P Bemko
(74) *Attorney, Agent, or Firm* — MH2 Technology Law Group LLP

(57) ABSTRACT

A spring lock system for use in attaching a wellbore component to a tubular includes a tubular spring body having a plurality of profiles along an axial length thereof. The tubular spring body is configured to move between an unclamped position and a clamped position. The spring lock system further includes a locking and activation pin disposed between the profiles of the tubular spring body. The locking and activation pin is rotatable relative to the tubular spring body to move the tubular spring body from the unclamped position to the clamped position.

11 Claims, 10 Drawing Sheets

RADIAL SPRING LOCK SYSTEM FOR COLLARS, SLEEVES AND CENTRALIZERS

CROSS-REFERENCE TO RELATED APPLICATIONS

This application claims priority to U.S. Provisional Patent Application having Ser. No. 62/431,149, filed on Dec. 7, 2016, which is incorporated herein by reference in its entirety.

BACKGROUND

Centralizers are commonly secured at spaced intervals along a casing string to provide radial stand-off of the casing string from the interior wall of a borehole in which the string is subsequently installed. Centralizers ideally center the casing within the borehole to provide a generally uniform annulus between the casing string exterior and the interior wall of the borehole. This centering of the casing string within the borehole promotes uniform and continuous distribution of cement slurry around the casing string during the subsequent step of cementing the casing string within an interval of the borehole. Uniform cement slurry distribution results in a cement liner that reinforces the casing string, isolates the casing string from corrosive formation fluids, and prevents unwanted fluid flow between penetrated geologic formations. However, the attachment of the centralizers to the casing string can be complex. Therefore there is a need for system to connect centralizers to the casing string.

SUMMARY

Embodiments of the disclosure may provide a spring lock system for use in attaching a wellbore component to a tubular. The spring lock system includes a tubular spring body having a plurality of profiles along an axial length thereof. The tubular spring body is configured to move between an unclamped position and a clamped position. The spring lock system further includes a locking and activation pin disposed between the profiles of the tubular spring body. The locking and activation pin is rotatable relative to the tubular spring body to move the tubular spring body from the unclamped position to the clamped position.

Embodiments of the disclosure may also provide a centralizer. The centralizer includes a centralizer body having a first hole and a second hole. The centralizer further includes a spring disposed within the centralizer body. The spring is configured to move between an unclamped position and a clamped position. Additionally, the centralizer includes a locking and activation pin disposed within the first hole of the centralizer. The locking and activation pin is rotatable relative to the spring to move the spring from the unclamped position to the clamped position.

Embodiments of the disclosure may further provide a method of installing a centralizer on a tubular. The method includes the step of positioning the centralizer on the tubular. The centralizer having a spring and a locking and activation pin. The method further includes the step of rotating the locking and activation pin relative to the spring which causes the spring to move from an unclamped position to a clamped position. Additionally, the method includes the step of attaching the centralizer to the tubular when the spring is in the clamped position.

The foregoing summary is intended to introduce a subset of the aspects of the present disclosure that are more fully described below. This summary is not intended to be exhaustive or to highlight key or important aspects of the disclosure, and should not be considered limiting on the scope of the following disclosure or the appended claims.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1A:
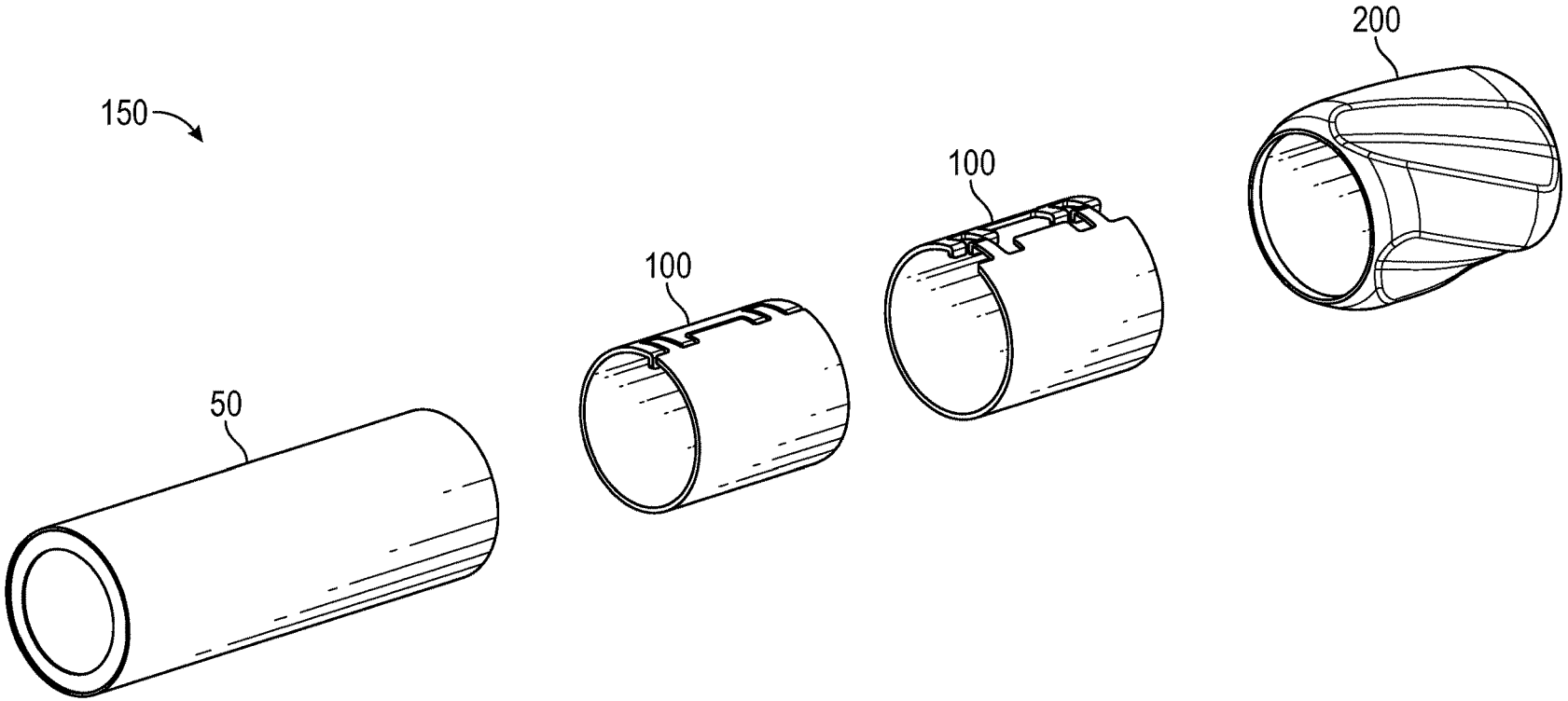
FIG. 1A illustrates a view of a radial spring lock system and a centralizer, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the present disclosure. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. The embodiments presented below may be combined in any way, e.g., any element from one embodiment may be used in any other embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. In the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B." In this disclosure, a radial spring lock system is described in relation to a centralizer. It is to be noted that the radial spring lock system may be used with other wellbore components, such as lock collars and sleeves.

Turning now to the specific, illustrated embodiments, FIG. 1A illustrates a view of a radial spring lock system 150 and a centralizer 200, according to an embodiment. As will be described herein, the radial spring lock system 150 is configured to attach the centralizer 200 to a tubular 50 (or casing string). The radial spring lock system 150 generally comprises a spring 100 and a locking and activation pin 125.

Figure 1B:
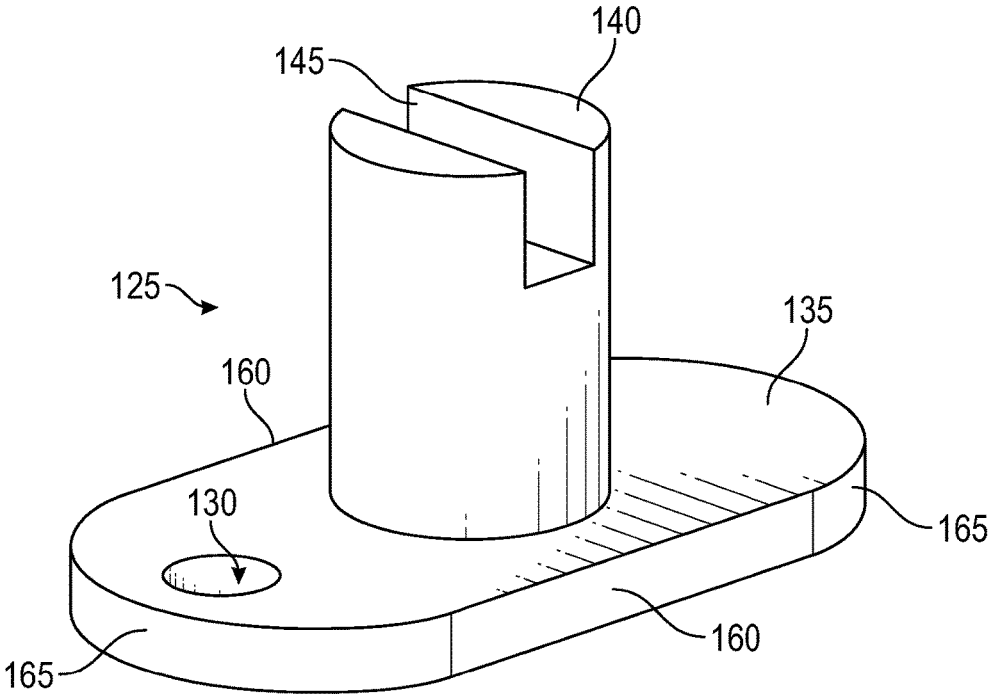
FIG. 1B illustrates a view of a locking and activation pin for use with the radial spring lock system, according to an embodiment.

FIG. 1B illustrates a view of the locking and activation pin 125 for use with the radial spring lock system 150, according to an embodiment. As shown, the locking and activation pin 125 includes a base 135 and an extension portion 140. The base 135 includes sides 160 and ends 165 that are configured to engage profiles in the spring 100. The base 135 also includes a threaded hole 130 that is configured to receive a locking bolt (not shown). The extension portion 140 includes a slot 145 that will be used to rotate the locking and activation pin 125 from an open position to a closed position as will be described herein. In one embodiment, the locking and activation pin 125 may be made from a composite material.

Figure 1C:
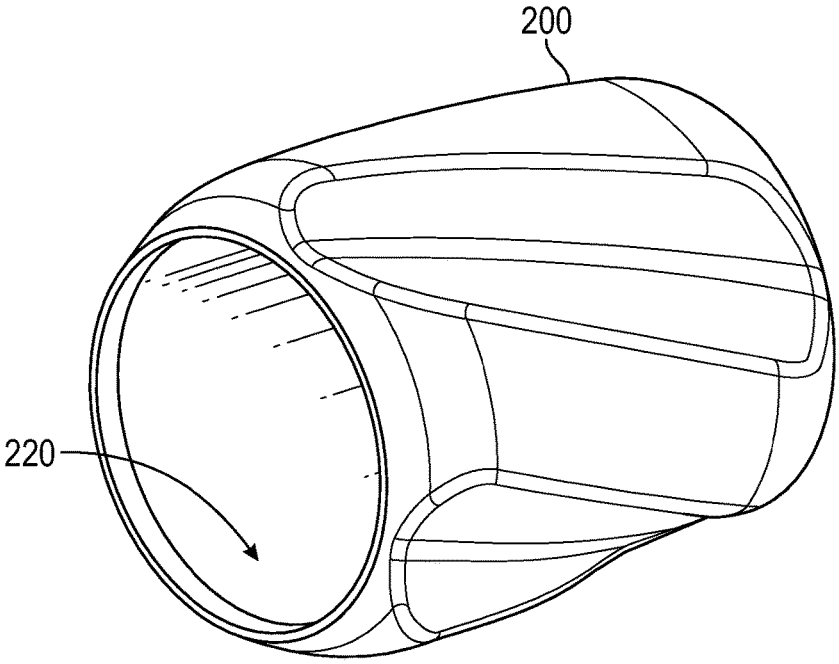
FIG. 1C illustrates a view of the centralizer for use with the radial spring lock system, according to an embodiment.

FIG. 1C illustrates a view of the centralizer 200 for use with the radial spring lock system 150. As shown, a portion of the inner diameter of the centralizer 200 may include a recess 220 for insertion of the prestressed spring 100. In one embodiment, the centralizer 200 may be made from a composite material.

Figure 2C:
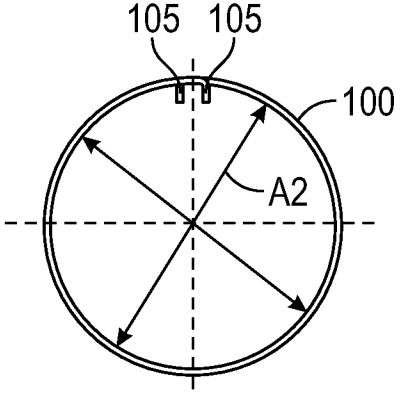
FIGS. 2A-2C illustrate views of a spring for use with the radial spring lock system, according to an embodiment.
Figure 2C:
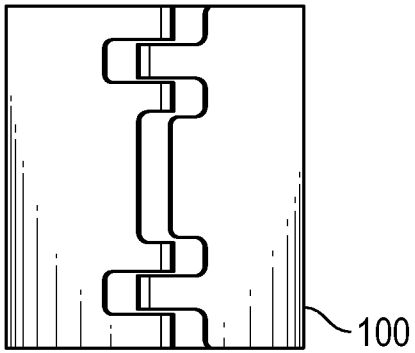
Figure 2B:
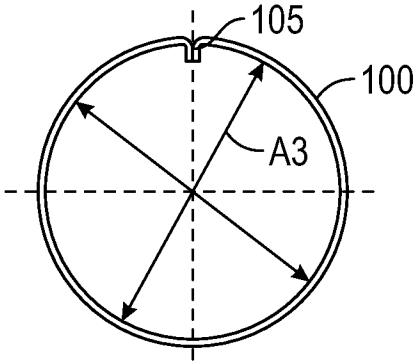
Figure 2B:
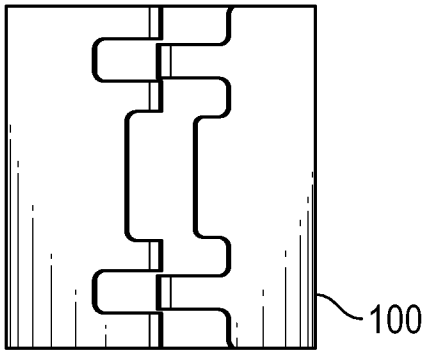
Figure 2A:
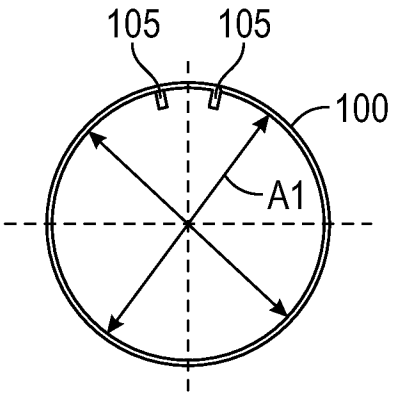
Figure 2A:
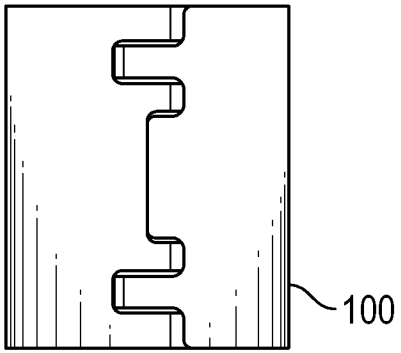

FIGS. 2A-2C illustrate views of the spring 100 for use with the radial spring lock system 150, according to an embodiment. As shown, the spring 100 is a tubular body.

Figure 3A:
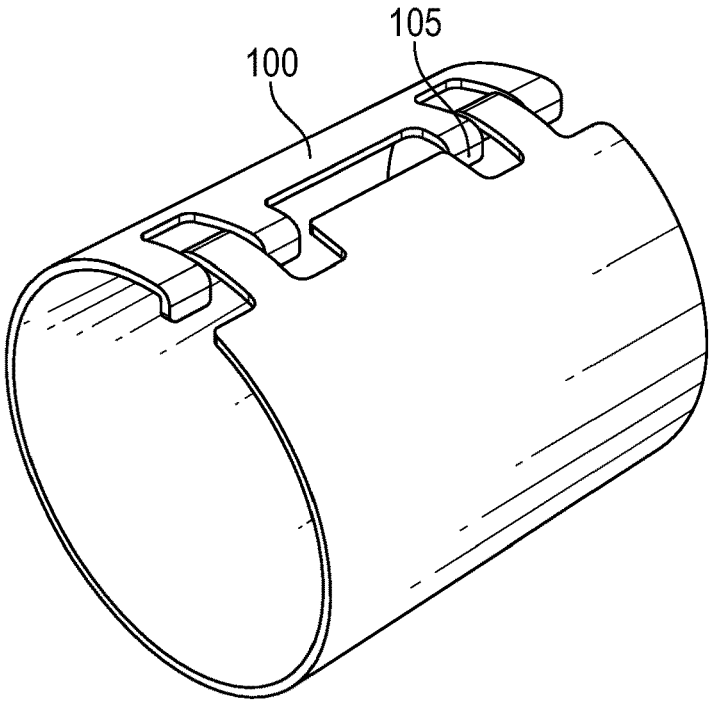
FIGS. 3A-3B illustrate views of the spring in an expanded state and a retracted state, according to an embodiment.
Figure 3B:
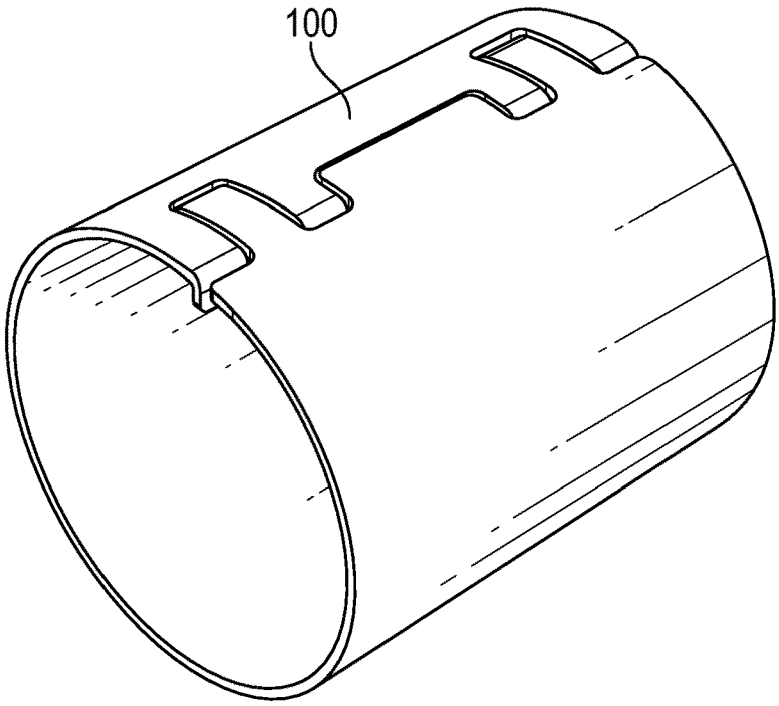

FIG. 2A illustrates the spring 100 in a compressed position. The spring 100 may be moved to the compressed position by using temporary lugs 105 to compress the spring 100. In the compressed position, the spring 100 has an inner diameter of A1. FIG. 2B illustrates the spring 100 in an expanded position. The spring 100 may be moved to the expanded position and then the activation pin 125 (not shown) may be used. In the expanded position, the spring 100 has an inner diameter of A2. FIG. 2C illustrates the spring 100 in a clamped position. As will be described herein, the activation pin 125 (not shown) is turned to release the spring 100 to a non-stressed ID. In the clamped position, the spring 100 has an inner diameter of A3. For reference, inner diameter A2 is greater than inner diameter A3, and inner diameter A3 is greater than inner diameter A1. In one embodiment, the spring 100 may be made from a composite material or a fiber reinforced composite material. In another embodiment, the interior surface of the spring 100 may include a rubber coating and/or adhesion ridges FIGS. 3A-3B illustrate views of the spring 100 in an expanded state and a retracted state, according to an embodiment. In one production step, the spring 100 is compressed by using the lugs 105. More specifically, a mechanical device may be used to push the lugs 105 away from each other which in turn causes the spring 100 to move from the expanded state (FIG. 3A) to the retracted state (FIG. 3B).

FIGS. 4A-4F illustrate views of the centralizer 200 and the radial spring lock system 150 in various production steps, according to an embodiment. For clarity, the centralizer 200 is shown in a hidden view.

Figure 4A:
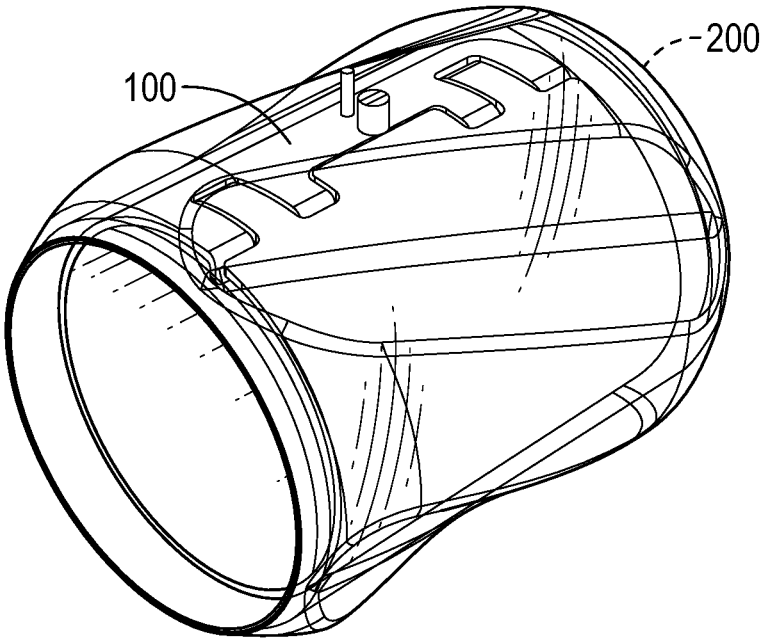
FIGS. 4A-4E illustrate views of the centralizer and the radial spring lock system in various production steps, according to an embodiment.
Figure 4B:
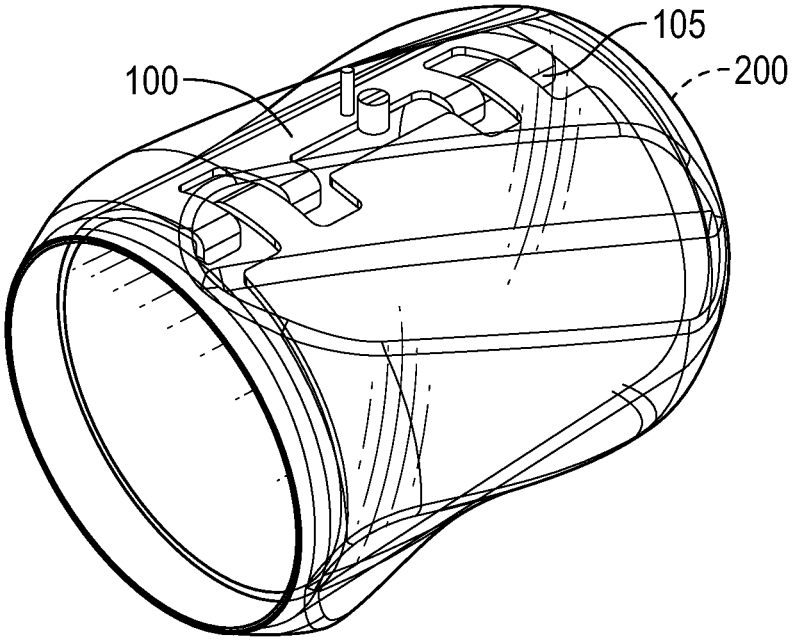
Figure 4C:
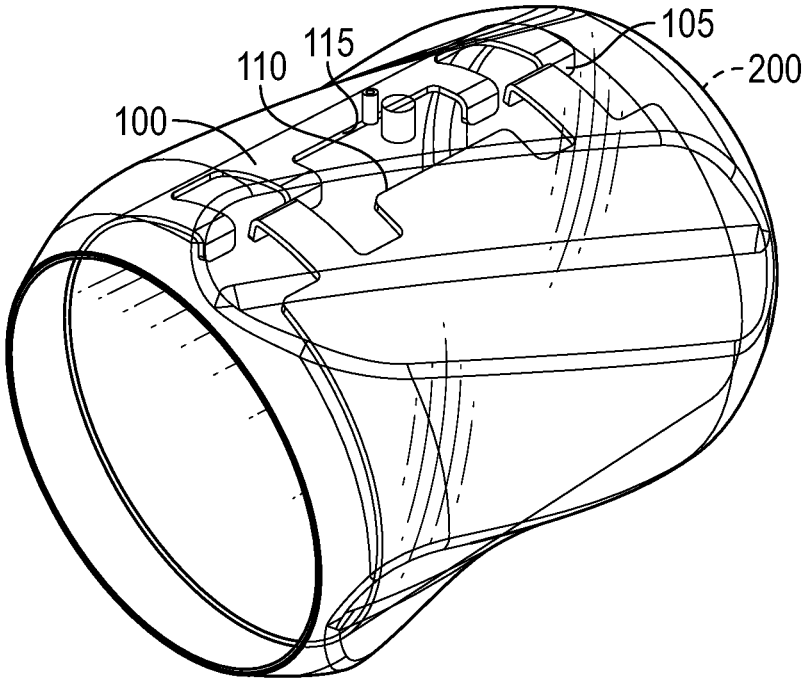
Figure 4D:
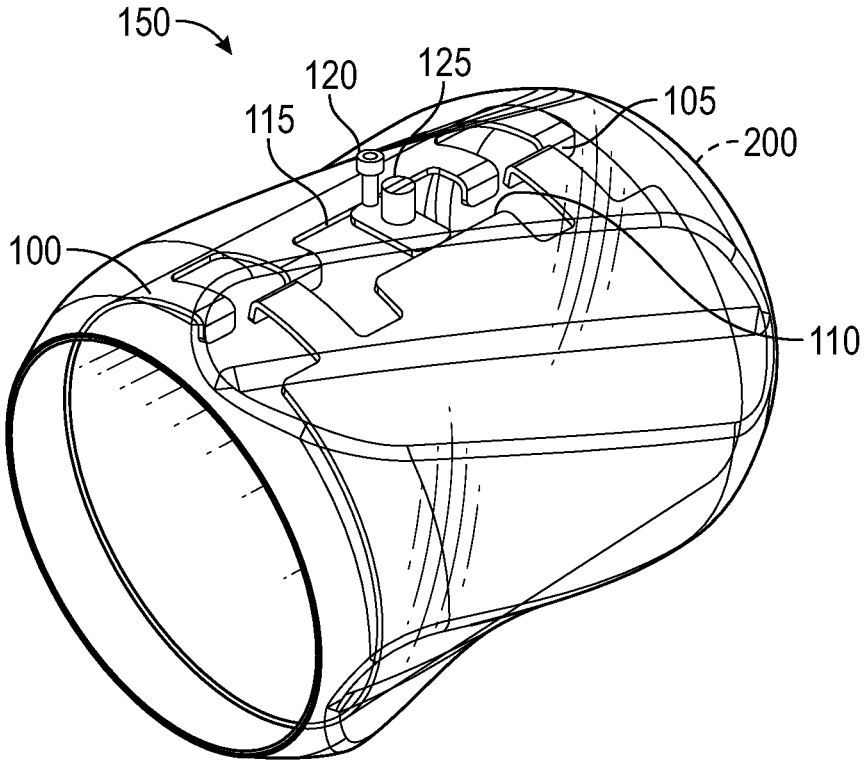
Figure 4E:
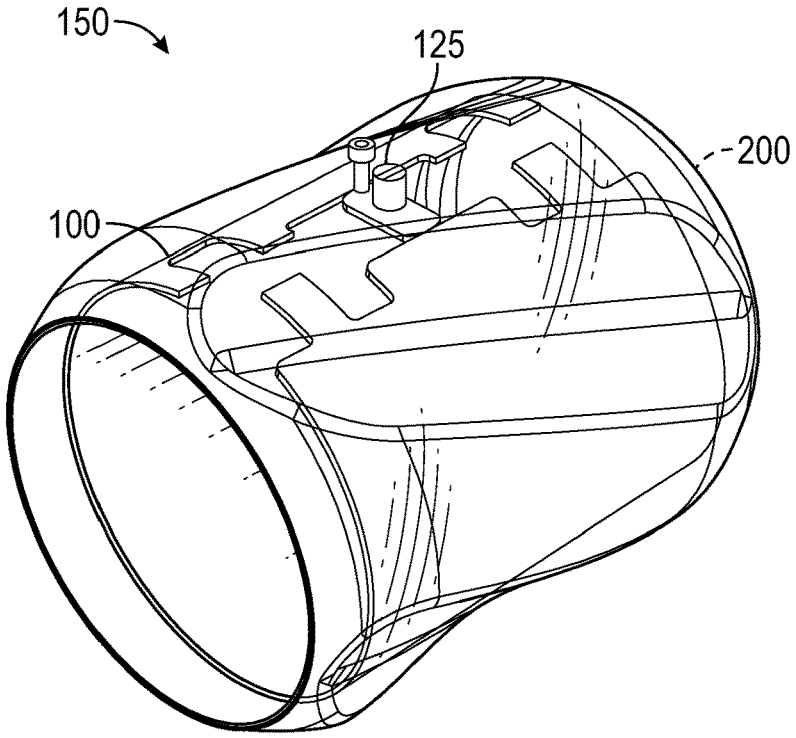

In FIG. 4A, the compressed spring 100 is inserted into an inner diameter of the centralizer 200. At this point, the spring 100 may engage the recess 220 (FIG. 1C) of the centralizer 200. In FIG. 4B, the spring 100 is released using the lugs 105 such that the spring 100 engages a portion of the inner diameter of the centralizer 200. In FIG. 4C, the spring 100 is expanded using the lugs 105 (and the mechanical device) such that the spring 100 engages a larger portion of the inner diameter of the centralizer 200. As also shown in FIG. 4C, the spring 100 includes a first profile 110 and a second profile 115. In FIG. 4D, the locking and activation pin 125 is inserted between the first profile 110 and the second profile 115 of the spring 100 in order to keep the spring 100 in an unclamped position. Upon insertion of the locking and activation pin 125 between the profiles 110, 115, the extension portion 140 of the locking and activation pin 125 extends into a hole 210 (FIG. 5) of the centralizer 200. Once the locking and activation pin 125 is in place, a lock bolt 120 may be inserted through a hole 215 (FIG. 5) of the centralizer 200. The lock bolt 120 may be connected to the threaded hole 130 (FIG. 1B) of the base 135 in the locking and activation pin 125. The locking bolt 120 is configured to hold the locking and activation pin 125 in the open position shown in FIG. 4D (i.e., spring 100 in the unclamped position). In FIG. 4E, the lugs 105 may be removed by cutting or grinding.

Figure 5:
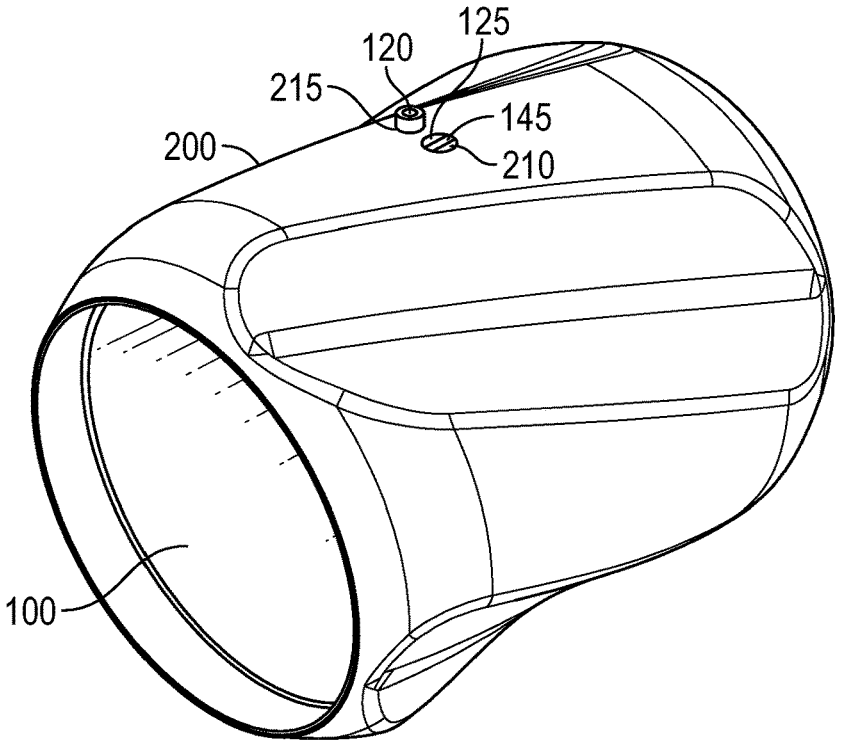
FIG. 5 illustrate a view of the centralizer with the radial spring lock system, according to an embodiment.

FIG. 5 illustrates a view of the centralizer 200 with the radial spring lock system 150, according to an embodiment. The centralizer 200 is ready to be placed on the tubular. As shown in FIG. 5, the lock bolt 120 extends from the hole 215 and the slot 145 of the locking and activation pin 125 is shown in the hole 210. As also shown in FIG. 5, the spring 100 is disposed within the centralizer 200. The spring 100 is held in the unclamped position by the locking and activation pin 125 and the lock bolt 120.

Figure 6A:
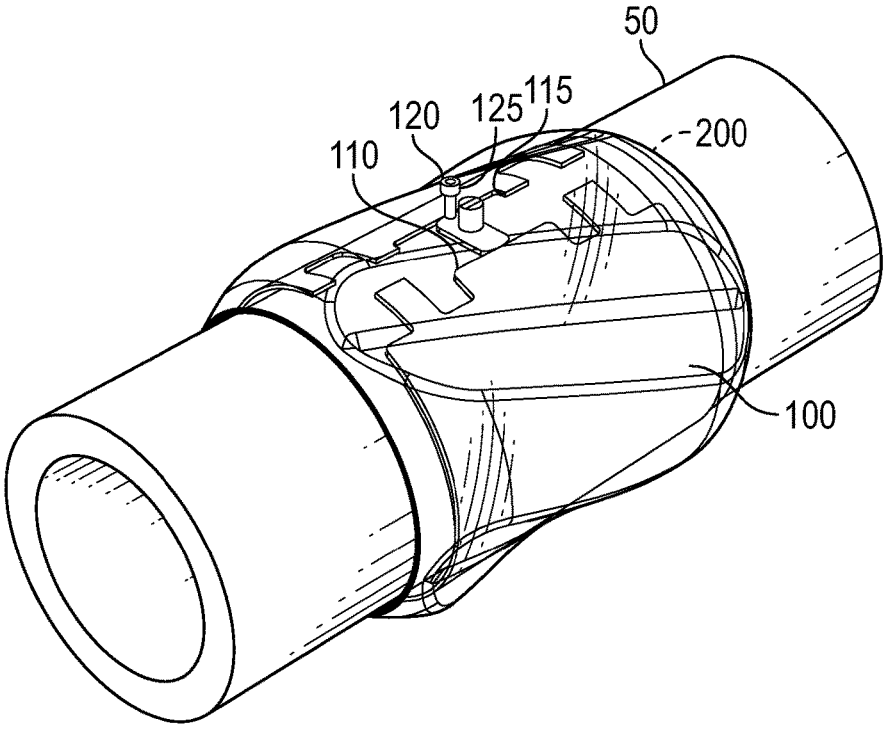
FIGS. 6A and 6B illustrate views of the centralizer being installed on a tubular, according to an embodiment.
Figure 6B:
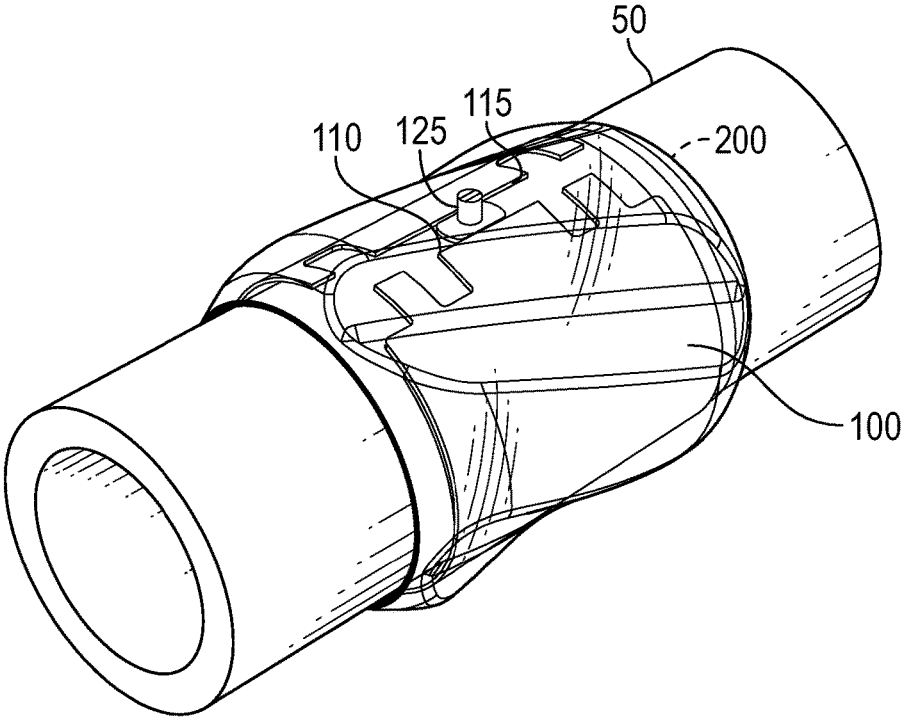

FIGS. 6A and 6B illustrate views of the centralizer 200 being installed on a tubular 50, according to an embodiment. For clarity, the centralizer 200 is shown as a hidden view.

In FIG. 6A, the centralizer 200 may be placed on the tubular 50. The spring 100 is in the unclamped position to allow the centralizer 200 to be placed at a desired location on the tubular 50. As shown in FIG. 6A, the ends 165 of the base 135 of the locking and activation pin 125 are engaged with the profiles 110, 115 of the spring 100 when the spring 100 is in the unclamped position. The locking and activation pin 125 is in the open position and the locking and activation pin 125 held in place by the lock bolt 120.

In FIG. 6B, the centralizer 200 is installed on the tubular 50. The spring 100 is in the clamped position to allow the centralizer 200 to be attached to the tubular 50. To move the spring 100 from the unclamped position (FIG. 6A) to the clamped position (FIG. 6B), the lock bolt 120 is removed from the base 135 of the locking and activation pin 125 and then a device (e.g., a screwdriver) may be used to rotate the locking and activation pin 125. Upon rotation of the locking and activation pin 125, the sides 160 of the base 135 engage the profiles 110, 115 of the spring 100. The locking and activation pin 125 is in the closed position. At this point, the spring 100 connects the centralizer 200 to the tubular 50.

Figure 7:
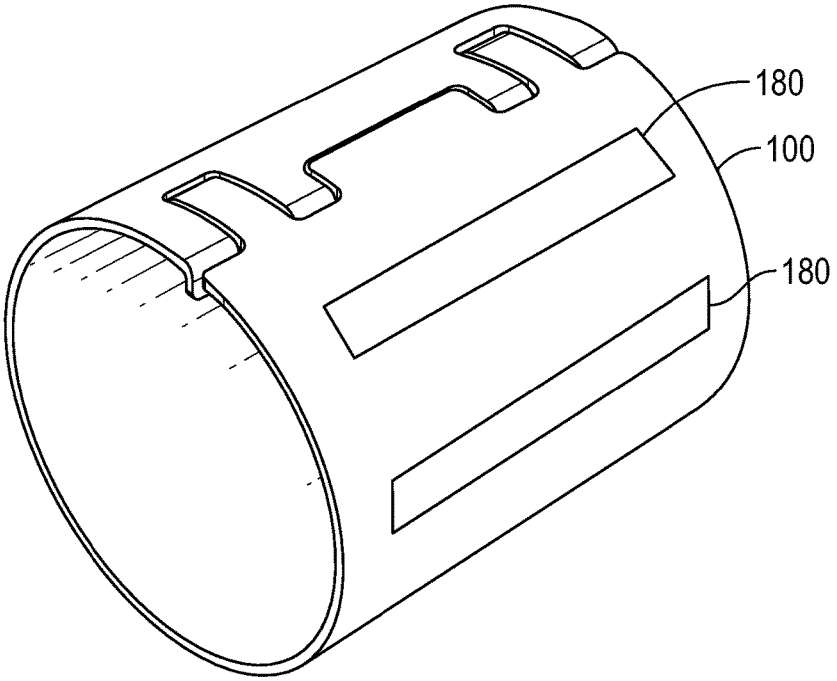
FIG. 7 illustrates a view of the spring for use with the radial spring lock system, according to an embodiment.

FIG. 7 illustrates a view of the spring 100 for use with the radial spring lock system, according to an embodiment. The spring 100 may have ridges 180 on the outer diameter to fit corresponding recesses (not shown) on the inner diameter of the centralizer 200. The engagement of the ridges 180 and recesses may increase the rotational load transfer between the spring 100 and the centralizer 200.

Figure 8:
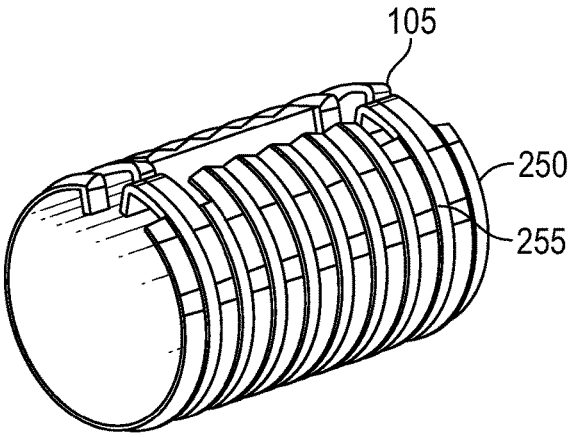
FIG. 8 illustrates a view of a spring, according to an embodiment.
Figure 9:
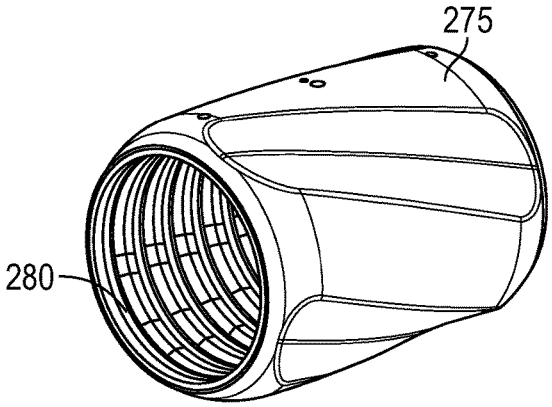
FIG. 9 illustrates a view of a centralizer, according to an embodiment.

FIG. 8 illustrates a view of a spring 250 and FIG. 9 illustrates a view of a centralizer 275. The spring 250 and the centralizer 275 are similar to the spring 100 and the centralizer 200, respectively. The spring 250 includes spring profiles 255 formed on an outside surface of the spring 250. The spring profiles 255 are configured to engage with centralizer profiles 280 on the centralizer 275 (See FIG. 9).

Figure 10:
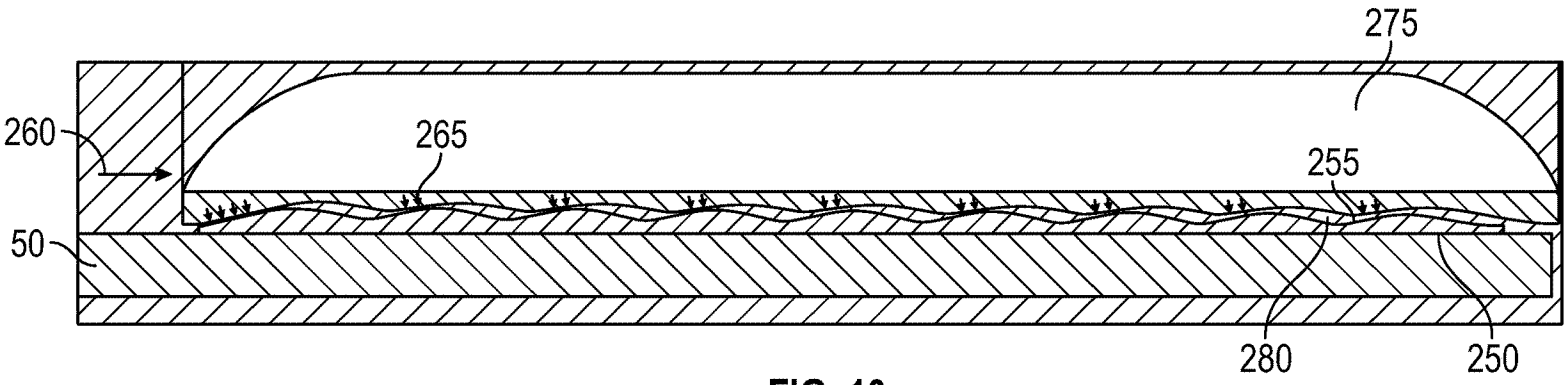
FIG. 10 illustrates a section view of the spring and the centralizer on the tubular, according to an embodiment.

FIG. 10 illustrates a section view of the spring 250 and the centralizer 275 on the tubular 50, according to an embodiment. As shown in FIG. 10, the spring profiles 255 on the spring 250 are engaged with the centralizer profiles 280 on the centralizer 275. Due to the angled radial profile (i.e., profiles 255, 280), an axial load (arrow 260) on the spring 250 will create a downward force (arrow 265) and thereby increase the clamp efficiency of the radial spring lock system.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A spring lock system for use in attaching a wellbore component to a tubular, the spring lock system comprising:

a tubular spring body having a plurality of profiles along an axial length thereof, the tubular spring body being configured to move between an unclamped position and a clamped position;

a locking and activation pin disposed between the profiles of the tubular spring body, the locking and activation pin being rotatable relative to the tubular spring body to move the tubular spring body from the unclamped position to the clamped position, wherein the locking and activation pin includes a protrusion attached to a base, the base having sides and ends; and a lock bolt that is configured to engage a threaded hole in the base of the locking and activation pin.

2. The spring lock system of claim 1, wherein the ends of the base engage the profiles of the tubular spring body when the tubular spring body is the unclamped position and the sides of the base engage the profiles of the tubular spring body when the tubular spring body is in the clamped positon.

3. The spring lock system of claim 1, wherein the protrusion of the locking and activation pin includes a slot which is used to rotate the locking and activation pin relative to the tubular spring body.

4. A centralizer comprising:

a centralizer body having a first hole and a second hole;

a spring disposed within the centralizer body, the spring being configured to move between an unclamped position and a clamped position;

a locking and activation pin disposed within the first hole of the centralizer, the locking and activation pin being rotatable relative to the spring to move the spring from the unclamped position to the clamped position; and a lock bolt disposed within the second hole of the centralizer body, the lock bolt being configured to engage the locking and activation pin.

5. The centralizer of claim 4, wherein the locking and activation pin includes a protrusion attached to a base, the base having sides and ends.

6. The centralizer of claim 5, wherein the ends of the base engage a plurality of profiles of the spring when the spring is the unclamped position and the sides of the base engage the profiles of the spring when the spring is in the clamped positon.

7. The centralizer of claim 5, wherein the protrusion of the locking and activation pin includes a slot which is used to rotate the locking and activation pin relative to the spring.

8. The centralizer of claim 4, wherein the spring includes ridges that engage recesses of the centralizer.

9. The centralizer of claim 4, wherein the spring includes spring profiles that are configured to engage centralizer profiles in the centralizer body.

10. A method of installing a centralizer on a tubular, the method comprising:

positioning the centralizer on the tubular, the centralizer having a spring and a locking and activation pin;

rotating the locking and activation pin relative to the spring which causes the spring to move from an unclamped position to a clamped position;

attaching the centralizer to the tubular when the spring is in the clamped positon; and removing a lock bolt in the centralizer prior to moving the spring from the unclamped position to the clamped position.

11. The method of claim 10, wherein the spring includes spring profiles that are configured to engage centralizer profiles in the centralizer.

* * * * *